US006419504B1

(12) United States Patent
Nelson

(10) Patent No.: US 6,419,504 B1
(45) Date of Patent: Jul. 16, 2002

(54) SLIDE LOCKED RETRACTABLE GROUNDING PIN POWER CORD PLUG

(76) Inventor: Richard Bryant Nelson, 5418 W. 77th St., Los Angeles, CA (US) 90045

( * ) Notice: Subject to any disclaimer, the term of this patent is extended or adjusted under 35 U.S.C. 154(b) by 0 days.

(21) Appl. No.: 09/837,005

(22) Filed: Apr. 17, 2001

(51) Int. Cl.[7] ..... H01R 13/648
(52) U.S. Cl. ..... 439/103
(58) Field of Search ..... 439/103, 104, 439/176, 171, 172, 174, 106

(56) References Cited

U.S. PATENT DOCUMENTS

| | | | | |
|---|---|---|---|---|
| 2,323,736 | A | | 7/1943 | Tousley |
| 2,897,469 | A | | 7/1959 | Morse |
| 2,984,808 | A | | 5/1961 | Bender |
| 2,989,719 | A | | 6/1961 | Aarlaht |
| 3,025,486 | A | | 3/1962 | Falconer |
| 3,171,113 | A | | 2/1965 | McNamara |
| 3,299,390 | A | | 1/1967 | Eclelkamp |
| 3,308,415 | A | | 3/1967 | Cramer et al. |
| 3,440,591 | A | | 4/1969 | Whatlen |
| 3,685,000 | A | | 8/1972 | Robbins |
| 3,754,202 | A | | 8/1973 | Nelson |
| 4,954,091 | A | | 9/1990 | Marble et al. |
| 5,641,292 | A | * | 6/1997 | Fann ..... 439/103 |

* cited by examiner

*Primary Examiner*—Gary Paumen
(74) *Attorney, Agent, or Firm*—Gene Scott-Patent Law & Venture Group

(57) ABSTRACT

A power cord connector engages a power outlet of the two wire or three wire types. The connector (plug) has a pair of spaced apart prongs in side by side parallel alignment and a grounding pin which is slidingly mounted within a recess in the connector body so as to be positionable between an extended position in parallel, spaced apart alignment with the prongs, and a retracted position fully enclosed within the recess. A biasing spring is positioned within the recess for urging the grounding pin into the extended position. A locking device includes a finger actuatable slide engaged with a tongue spring enabling the tongue to be moved into a locking position inhibiting retraction of the grounding pin.

8 Claims, 3 Drawing Sheets

SLIDE LOCKED RETRACTABLE GROUNDING PIN POWER CORD PLUG

The present invention is based upon a prior filed disclosure under the Document Disclosure Program of the US PTO filed as Ser. No. 048975 on Jun. 21, 1976.

BACKGROUND OF THE INVENTION

1. Field of the Invention

This invention relates generally to electrical sockets and plugs and more particularly to a plug for use in joining an electrical appliance or circuit with an electrical outlet such as the common three wire outlet used in the United States for connecting to the 110 volt power supply line.

2. Description of Related Art

The following art defines the present state of this field:

Marble et al, U.S. Pat. No. 4,954,091 describes a convertible ground safety plug consisting of a grounding prong carried in an insulated housing. The ground prong can be moved between an active position projecting outwardly from the housing and an inactive position not projecting outwardly from the housing, so that the plug can be utilized for a three slot receptacle and a two slot receptacle.

Nelson, U.S. Pat. No. 3,754,202 describes a convertible ground safety plug consisting of a grounding prong carried in an insulated housing. The ground prong can be moved between an active position projecting outwardly from the housing and an inactive position not projecting outwardly from the housing, so that the plug can be utilized for a three slot receptacle and a two slot receptacle.

Robbins, U.S. Pat. No. 3,685,000 describes a plug having a pair of fixed prongs, a retractable grounding pin, and a grounding wire is provided for making an electrical connection by insertion in a female receptacle. The fixed prongs are connected to the line and load leads of a power cord and the grounding wire is connected to the ground lead of the power cord. The grounding wire is provided with a hook shaped terminal and the retractable grounding pin is formed with an annular groove adapted for locking engagement with the terminal. If the female receptacle is of the type adapted to receive a three prong male plug, the grounding wire is locked within the annular groove by means of the terminal, whereby the grounding pin is secured in the extended position. If the female receptacle is of the type adapted to receive a two prong male plug, the grounding wire is attached to a ground point on the box housing the receptacle by means of the terminal whereby the grounding pin is retracted as the plug is inserted in the receptacle.

Whalen, U.S. Pat. No. 3,440,591 describes an electric plug cap adaptor for converting a three terminal plug cap to fit a two terminal receptacle, comprising a plug body having two substantially flat surfaces, one of said faces forming a three-terminal receptacle to receive a three-terminal plug cap, catch means in said receptacle to lock said receptacle to receive a three terminal plug cap, catch means in said receptacle to lock said receptacle to said plug cap, a pair of contact blades projecting parallelly outward from said other face and being electrically connected to said three-terminal plug cap, an electrically conductive support member embedded in said body and connected to said ground terminal receptacle, a groove in the other face of said body, a ground terminal member pivotally mounted on said support member, said ground terminal being rotatable into said groove, and lock means biased toward said ground terminal to move said ground terminal out of said groove and for locking said ground terminal in a fixed parallel relation with respect to said contact blades.

Cramer et al, U.S. Pat. No. 3,308,415 describes an electrical plug comprising in combination: a plug body of insulating material defining and internal passageway; a pair of blade contacts extending generally parallel to said passageway and projecting outwardly from a surface of said plug body; a ground pin non-circular in cross-section extending generally parallel to said pair of blade contacts and projecting outwardly from said surface of said plug body, said ground pin having an axial cylindrical extension inserted into said passageway of said plug body; spring means inside said passageway biasing said axial cylindrical extension and said ground pin in a direction longitudinally thereof; and cooperating guide means on said plug body and said axial cylindrical extension for causing a combined rotary and linear motion of said ground pin into said passageway defined by said plug body in response to axial pressure upon said ground pin opposed to the bias of said spring means.

Eckelkamp, U.S. Pat. No. 3,299,390 describes an electric plug having an outwardly extending magnetic ground connector plate and two outwardly extending prongs, said plug providing an electrical coupling means between a three wire system having two current carrying wires and a ground and a wall receptacle adapted to receive only two-prong male plugs; said plug comprising a plug housing having means for electrically connecting said two wires and said ground to three internal connections in said plug housing, means for connecting each of said outwardly extending prongs to a current carrying connection in said housing, and means in said housing for making electrical contact between the ground connection in said housing and said outwardly extending magnetic connector plate.

McNamara, U.S. Pat. No. 3,171,113 describes an electric plug including a casing, a pair of spaced blade contacts projecting from said casing and adapted to be electrically connected to two conductor wires of an electric cord leading from the casing for completing an electric circuit through said wires when the blades are received in and electrically connected to an electrical outlet receptacle, a ground contact slidably mounted in and spring urged outwardly of a part of the casing and adapted to be electrically connected to a third ground wire of the electric cord, said ground contact being disposed relative to said blades to engage an electrically grounded part of the receptacle when the blades are electrically connected thereto, and a testing unit supported by said casing including an electrically energized signal electrically connected to said ground contact and a movable contact electrically connected to the signal and selectively engageable with said blades for completing and electric circuit between one of the blades and the ground contact to indicate grounding of the third wire.

Falconer, U.S. Pat. No. 3,025,486 describes an electric plug comprising a housing, first and second terminals in said housing having first and second conductors respectively connected thereto, first and second stationary prongs projecting outwardly from said housing terminals, a a cylindrical core, means telescopically mounting said core in said housing, said first and second contacts on said core comprising respectively and externally threaded core and a central contact pin, spring means disposed between said core and said housing for urging said core out of said housing, and first and second electrical contacts on said core respectively connected to said first and second terminals when said core is out of said housing, detent means operatively connected between said housing and core resisting said spring urging, and detent release means carried by said housing for releasing said detent means to allow said spring to project said core from said housing, said detent release means comprising a lever pivoted to said housing and having a push button on one end and said detent on its other end.

Aarlaht, U.S. Pat. No. 2,989,719 describes a convertible plug comprising, in combination, a housing having a terminal wire plate at one end, a composite control plate assembly at the opposite end, said control plate assembly including an outermost plate and an innermost plate arranged face to face with the outermost plate, spacer pins securing the terminal wire plate in assembly relationship with the innermost plate of said control plate assembly, a plurality of bores formed in said control plate assembly, a plurality of bores formed in said control plate assembly, a pair of prongs, means supporting said prongs in the bores of said control plate assembly for relative rotation about individual longitudinal axes whereby said prongs are adapted to be arranged in predetermined angular positions with respect to each other, said prongs being electrically connected to terminals on said terminal wire plate, an outside base plate arranged face to face with the outermost plate of said control plate assembly, a plurality of angularly arranged openings in said outside base plate through which said prongs project and are thereby retained in predetermined adjusted positions, and means connecting said outside base plate with the outermost plate of said control plate assembly whereby said outside base plate is detachable from said control plate so that said prongs can be rotated in the control plate assembly from one adjusted position to another adjusted position when the outside base plate is removed form the plug.

Bender, U.S. Pat. No. 2,984,808 describes a convertible electric connector plug with grounding contact, said plug comprising an insulation shell, two male contact elements fixedly mounted in said shell protruding therefrom, a third male contact element, and yieldable hinge means supporting said third contact element in the shell pivotal between an operative position parallel to the two fixed contact elements and an inoperative position substantially transversely thereto, said hinge means including a metal sleeve mounted within said shell parallel to said two fixed contact elements, the inner end of said sleeve constituting a wire terminal and the outer end having two longitudinal, diametrically opposite slots to impart springiness to said slotted sleeve, and a hinge pin for said third contact element crossing said sleeve at a right angle to said slot, said slots being partly widened to receive said third contact element with a pressure grip in its inoperative position, said third contact element occupying a position in alignment with the sleeve in the operative position of said third element, said third contact element constituting the grounding contact.

Morse, U.S. Pat. No. 2,897,469 describes a self-grounding electrical attachment plug comprising: a molded plug body, at least one power prong within said plug body, a grounding element including a grounding prong and a flexible grounding prong support, said grounding prong support, said grounding prong support having a mounting member formed integrally with respect to said plug body and a prong supporting portion interconnected to said mounting member through a resilient bend portion of reduced cross section, said resilient bend portion being offset with respect to the principal axis of said grounding prong, whereby a force exerted axially upon said grounding prong will cause said bend portion to flex in a predetermined direction.

Tousley, U.S. Pat. No. 2,323,736 describes an electrical attachment plug comprising a body member, spaced contact elements mounted on said body member and adapted for engagement with terminal members of a receptacle to complete and electrical circuit, a contact element movably mounted with respect to said body member adapted for engagement with a terminal member of a receptacle, manually operable means for locking said last-named contact member in position with respect to said body, and a spring normally urging said last-named contact element into extended relation to said body member, said spring being characterized as having a capacity slightly greater than required to overcome the friction between said last-named contact element and its mounting in said body member but insufficient to force the said last-named contact element into operative relation to a terminal member of a receptacle provided therefore, thereby preventing the said attachment being forced out of cooperative relation with a receptacle in which a loose or faulty connection exists between said first-named contact members and their cooperating terminal members for a receptacle.

A considerable body of prior art teaches the use of electrical connectors for the 110 volt system in the United States. The conversion of outlet boxes from a two wire, to a three wire system presented a problem with new appliances which carried a three prong connector, but which were unable to be inserted into the older two slotted outlets. The prior art defines several thoughtful approaches to solving this problem but none that are easily enabled by the movement of a simple slide which provides for a positive locking of a retractable third pin in a deployed state. The present invention fulfills these needs and provides further related advantages as described in the following summary.

SUMMARY OF THE INVENTION

The present invention teaches certain benefits in construction and use which give rise to the objectives described below.

A power cord connector engages a power outlet of the two wire or three wire types. The connector (plug) has a pair of spaced apart prongs in side by side parallel alignment and a grounding pin which is slidingly mounted within a recess in the connector body so as to be positionable between an extended position in parallel, spaced apart alignment with the prongs, and a retracted position fully enclosed within the recess. A biasing spring is positioned within the recess for urging the grounding pin into the extended position. A locking device includes a finger actuatable slide engaged with a tongue of a spring temper material enabling the tongue to be moved into a locking position inhibiting retraction of the grounding pin.

A primary objective of the present invention is to provide an apparatus and method of use of such apparatus that provides advantages not taught by the prior art.

Another objective is to provide such an invention capable of connecting a power cord with either a two or a three wire wall outlet.

A further objective is to provide such an invention capable of being manually converted between two and three wire interconnection by use of a finger actuated sliding element.

A still further objective is to provide such an invention capable of simple fabrication and assembly.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
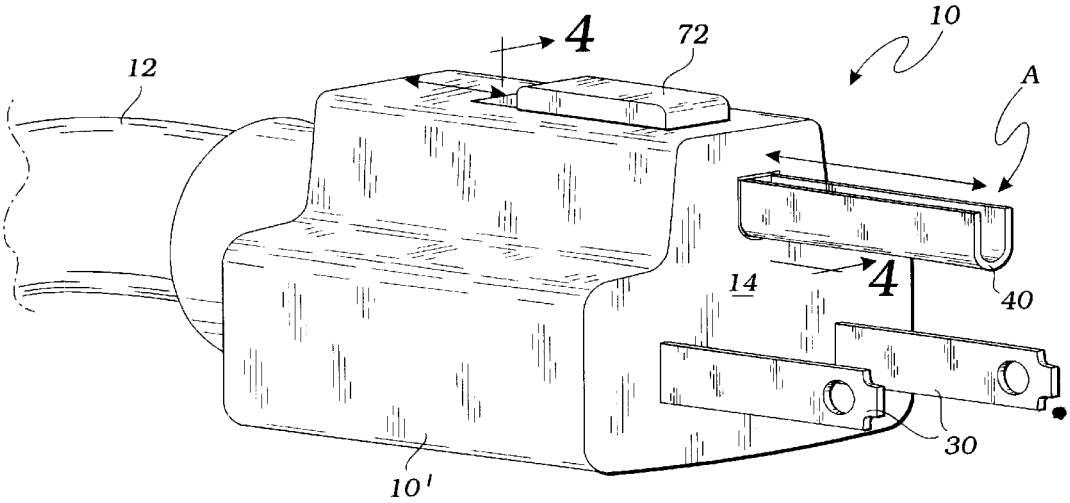
FIGS. 1 and 2 are perspective views of the preferred embodiment of the invention showing a grounding pin of the invention in a deployed extended position and a retracted position respectively.
Figure 2:
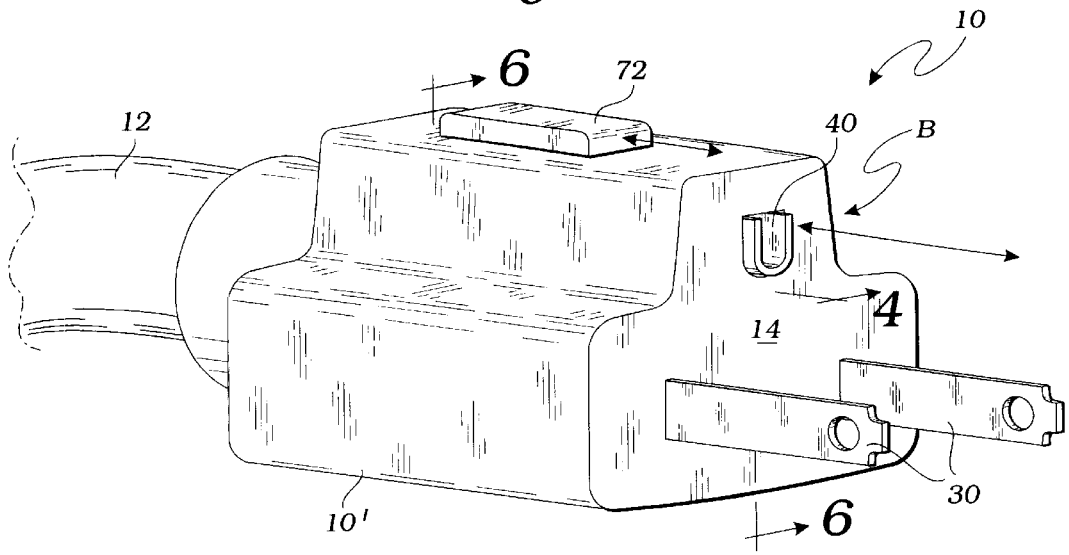
Figure 3:
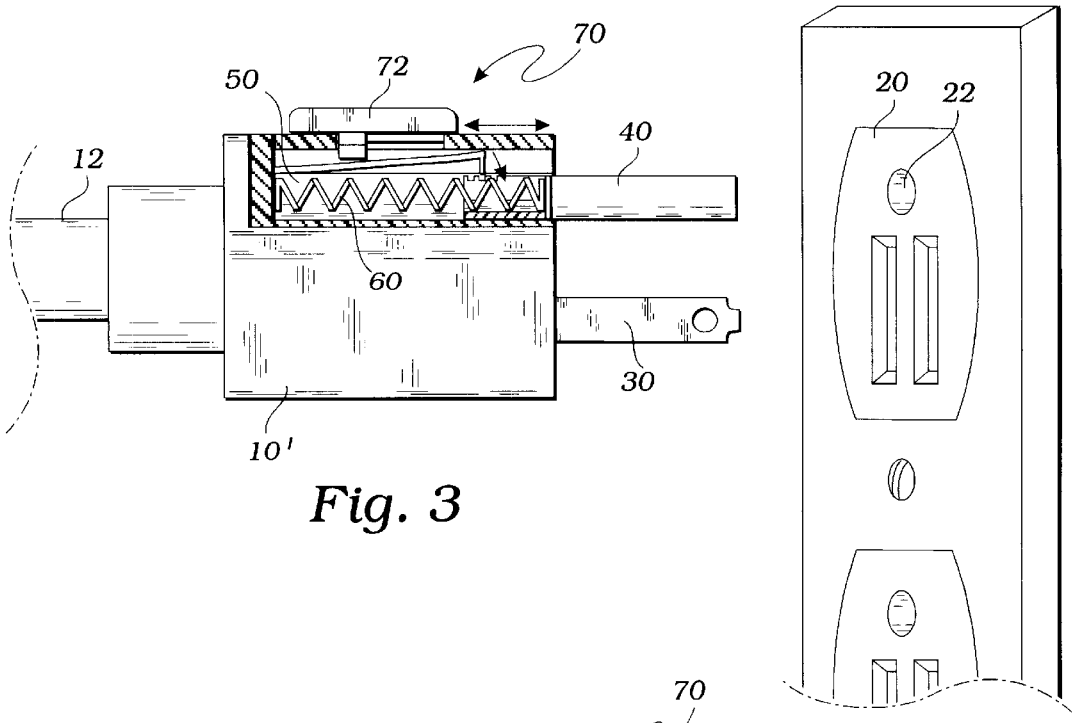
FIGS. 3 and 5 are partial section views thereof showing a slide of the invention in a first non-actuated position.
Figure 5:
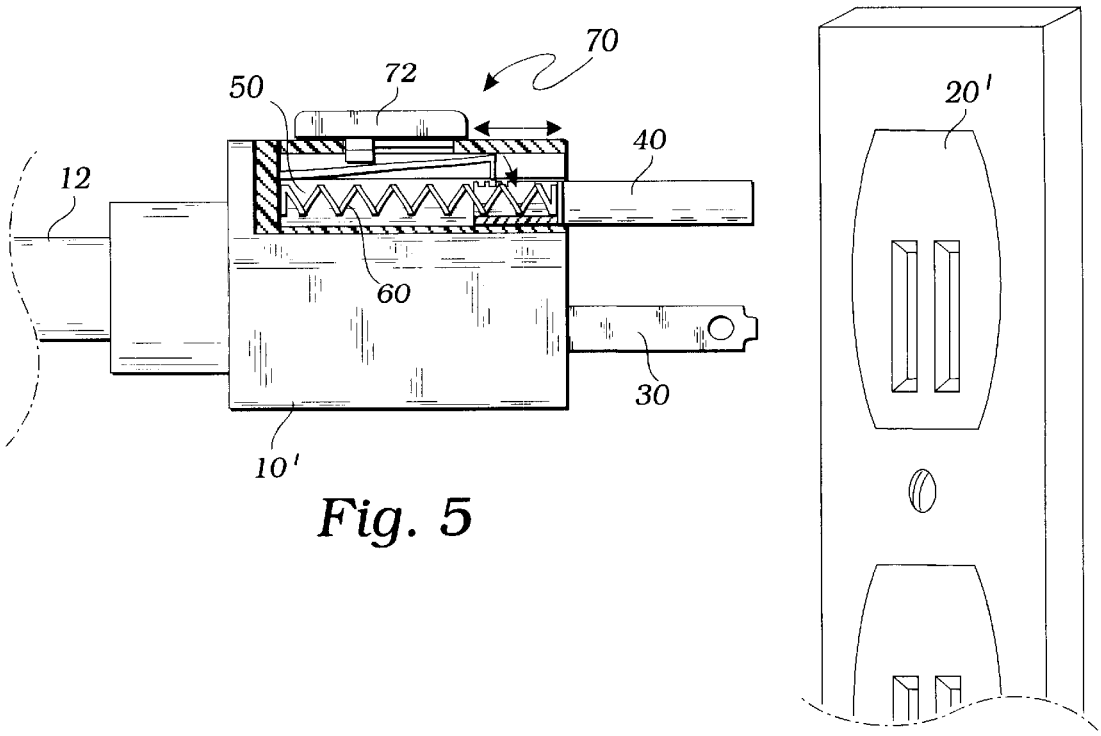

The present invention is an electrical power line connector apparatus 10 of the general type in common use in the United States, for engaging a power outlet 20 in FIG. 3, or 20' in FIG. 5, also of the general types in common use in the United States. The instant invention is similar to my prior invention described in U.S. Pat. No. 3,754,202, issued on Aug. 21, 1973, which document is incorporated hereinto by reference, and a copy of which is attached hereto. The improvement in the present invention includes a manual locking enablement for the retractable pin, as further described below. The power outlet 20' is an older two slot type previously in common use and still found in many older installations. The power outlet 20 is a newer three slot type found in all current installations. The third slot 22 is joined directly with the junction box and cable shields or conduits (not shown) which form a part of the electrical grounding network of all power distribution systems in use today.

The connector apparatus 10 is connected or molded directly onto the end of a power line or cord 12 as shown in the figures. The connector apparatus 10 includes a connector body 10' integral with the electrical cord 12. The connector body 10' engages a pair of spaced apart prongs 30 (also commonly referred to as "blades") of an electrically conductive material such as copper or brass. The prongs 30 extend in side by side parallel alignment from a terminal surface 14 of the connector body 10'. A grounding pin 40, also preferably of copper or brass, is slidingly mounted within a recess 50 in the connector body 10' so as to be positionable between an extended position "A" in parallel, spaced apart alignment with the prongs 30, and a retracted position "B" fully enclosed within the recess 50. A biasing means 60, such as the coil spring shown in FIGS. 3–6 is positioned within the recess 50 and engaged with the grounding pin 40 for urging the grounding pin 40 into the extended position "A." A locking means 70 preferably comprises a finger actuatable slide 72 (also referred to as an "element") is engaged with a tongue 74 enabling the tongue into a locking position "C" (FIG. 4) and thereby inhibiting retraction of the grounding pin 40. The slide 72 presses on the tongue 74 causing it to deflect. When the slide 72 is moved away from the tongue 74, the tongue resumes its original non-deflected position.

To provide for a positive locking feature, the grounding pin 40 has a slot 42 (FIG. 4) at a proximal end thereof. The tongue provides a tongue finger 76 (FIG. 6), whereby the tongue finger 76 is normally disengaged from the grounding pin slot 42 but is alternately engagable with the grounding pin slot when the grounding pin 40 is in the extended position "A" and the slide 72 is positioned for pressing the tongue finger 76 into the grounding pin slot 42.

Figure 4:
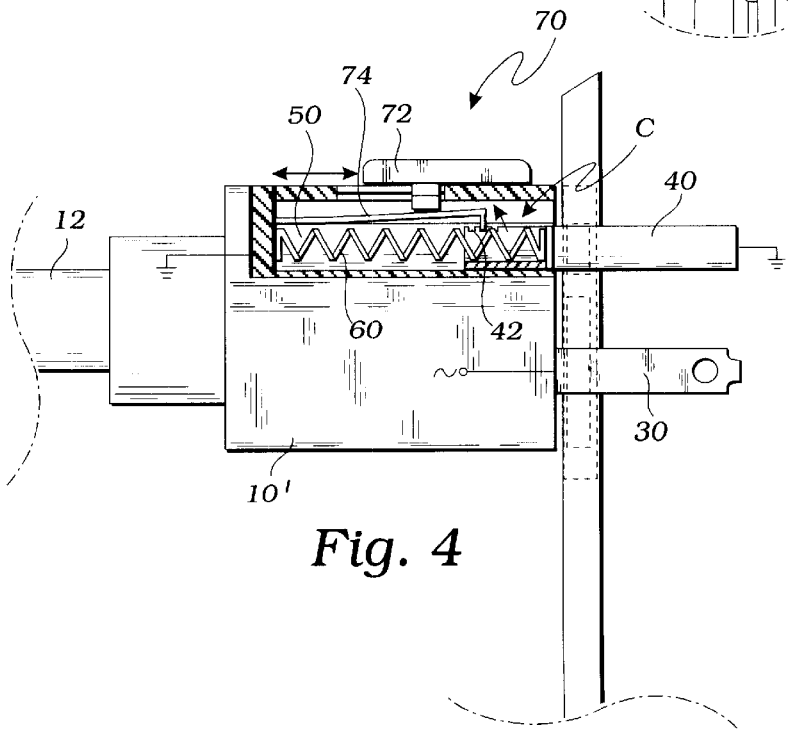
FIG. 4 is a partial section view thereof taken along line 4—4 in FIG. 1 showing the slide of the invention in a second actuated position.
Figure 6:
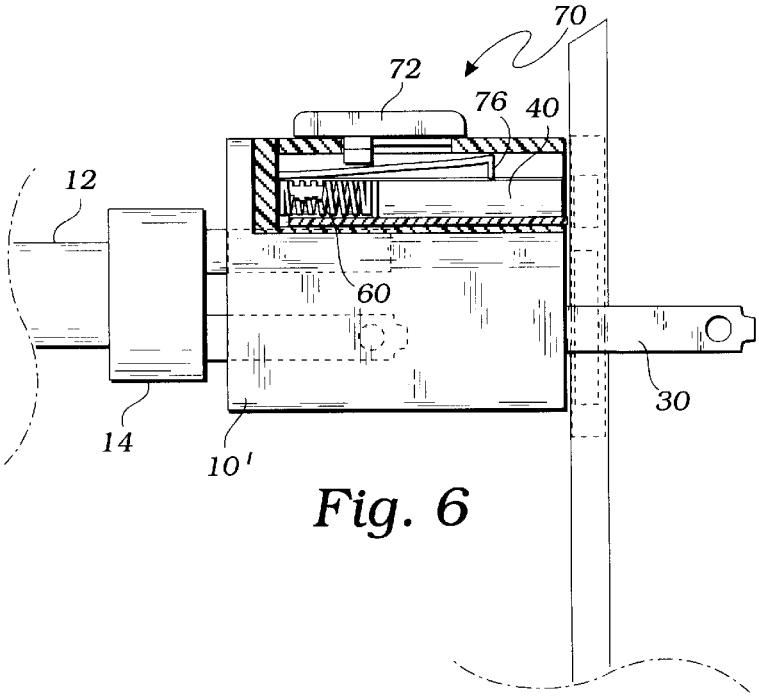
FIG. 6 is a partial section view thereof taken along line 6—6 in FIG. 2.

In use, the connector apparatus 10 is able to be used with either a two slot outlet 20' or a three slot outlet 20. When used with the two slot outlet 20', as shown in FIG. 6, the slide 72 is manually pulled back as shown in FIGS. 2, 3, 5 and 6 so that the grounding pin 40 is free to retract when the apparatus 10 is engaged in outlet 20'. When the apparatus 10 is used with a three slot outlet 20, the grounding pin 40 is locked in the extended position as shown in FIG. 4 so that the pin 40 may be engaged within the ground slot 22 of the outlet 20. It is not shown in the figures, but the two prongs 30 and the grounding pin 40 are joined to current carrying wires in the electrical cord 12 to provide current to the appliance to which the cord 12 is attached, and to provide a ground path to the appliance through pin 40. The current carrying wire connected to pin 40 is normally electrically interconnected to a chassis of the appliance so that if a short should occur between the circuit and the chassis, a user touching the chassis can not be electrocuted.

Clearly, the connector apparatus 10 may also be formed as an adapter wherein it is not connected or molded directly onto the end of a power line or cord 12 as shown in the figures. In this case, the connector apparatus 10 may include a standard plug socket for receiving a standard plug 14 as shown in FIG. 6. Thus, when a modern appliance might be used with either a two slot outlet as shown in FIG. 5, or alternately with a three slot outlet, as shown in FIG. 3, the present invention may be used to assure electrical connections. This might be the case with a workman moving from installation to installation.

When it is desired to assure an electrical ground connection through the pin 40 even when being used in a two slotted electrical outlet, the simple metal adapters shown in the incorporated reference U.S. Pat. No. 3,754,202, FIGS. 9–13 may be used with the present invention such that the pin 40 is placed into contact with any one of the metal adapters which, in turn, are joined to the building ground circuit through the cover plate mounting screw.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An electrical power connector apparatus for engaging a power outlet which comprises: a connector body integral with an electrical cord, the connector body having a pair of spaced apart prongs of an electrically conductive material, the prongs extending from a terminal surface of the connector body; and a grounding pin slidingly mounted within a recess in the connector body so as to be positionable between an extended position in parallel, spaced apart alignment with the prongs, and a retracted position fully enclosed within the recess; a biasing means positioned within the recess and engaged with the grounding pin for urging the grounding pin into the extended position; and a locking means comprising a finger actuatable element engaged with a tongue and enabling the tongue to move into a locking position inhibiting retraction of the grounding pin.

2. The apparatus of claim 1 wherein the grounding pin provides a slot for accepting a finger of the tongue, whereby the tongue finger is disengagable from the grounding pin slot, and alternately engagable with the grounding pin slot when the grounding pin is in the extended position, the finger actuatable element enabled for pressing the tongue finger into the grounding pin slot.

3. The apparatus of claim 1 wherein the biasing means is a coil spring.

4. The apparatus of claim 1 wherein the tongue is of a material and temper as to move as a spring with resilience and positional memory.

5. An electrical power connector apparatus for engaging a power outlet and an electrical cord which comprises: a connector body having a pair of spaced apart prongs of an electrically conductive material, the prongs extending from a terminal surface of the connector body; and a grounding pin slidingly mounted within a recess in the connector body so as to be positionable between an extended position in parallel, spaced apart alignment with the prongs, and a retracted position fully enclosed within the recess; a biasing means positioned within the recess and engaged with the grounding pin for urging the grounding pin into the extended position; and a locking means comprising a finger actuatable element engaged with a tongue enabling the tongue to move into a locking position inhibiting retraction of the grounding pin.

6. The apparatus of claim 5 wherein the grounding pin provides a slot for accepting a finger of the tongue, whereby the tongue finger is disengagable from the grounding pin slot, and alternately engagable with the grounding pin slot when the grounding pin is in the extended position, the slide enabled for pressing the tongue finger into the grounding pin slot.

7. The apparatus of claim 5 wherein the biasing means is a coil spring.

8. The apparatus of claim 5 wherein the tongue is of a material and temper as to move as a spring with resilience and positional memory.

* * * * *